United States Patent [19]

Hellwig et al.

[11] Patent Number: 4,942,805

[45] Date of Patent: Jul. 24, 1990

[54] VENTILATED PANEL

[75] Inventors: John Hellwig, Toronto; Philip Bradbury, North York, both of Canada

[73] Assignee: Teknion Furniture Systems Inc., Downsview, Canada

[21] Appl. No.: 305,097

[22] Filed: Feb. 2, 1989

[51] Int. Cl.[5] ..... F24F 7/007

[52] U.S. Cl. ..... 98/1; 52/27; 52/239; 98/39.1; 98/94.1; 98/115.3

[58] Field of Search ..... 52/284, 285, 286, 239, 52/27; 98/1, 39.1, 40.01, 94.1, 115.3, 31.5; 312/223, 236

[56] References Cited

U.S. PATENT DOCUMENTS

| | | | |
|---|---|---|---|
| 2,193,284 | 3/1940 | Hueglin | 98/94.1 |
| 2,898,837 | 8/1959 | Scarselli | 98/1 |
| 4,378,727 | 4/1983 | Doss | 312/236 X |
| 4,773,310 | 9/1988 | Corwin | 98/94.1 X |
| 4,784,445 | 11/1988 | Ott | 312/236 |

FOREIGN PATENT DOCUMENTS

| | | | |
|---|---|---|---|
| 33348 | 3/1977 | Japan | 98/94.1 |

*Primary Examiner*—Harold Joyce

[57] ABSTRACT

A modular office panelling system has been improved by providing an air circulation arrangement of selectively cool or remove heat from a particular area defined by the panelling system. Fans are provided in removable panel cover portions which can advantageously be secured in the office panelling system in the same manner as fabric covered removable cover portions. Thus, the air circulation arrangement may be provided as an original specification or added as a retrofit in the field. The interior of the panel is also used as a large inlet plenum whereby the flow of air into the panel is at a slow velocity.

15 Claims, 4 Drawing Sheets

FIG. 2
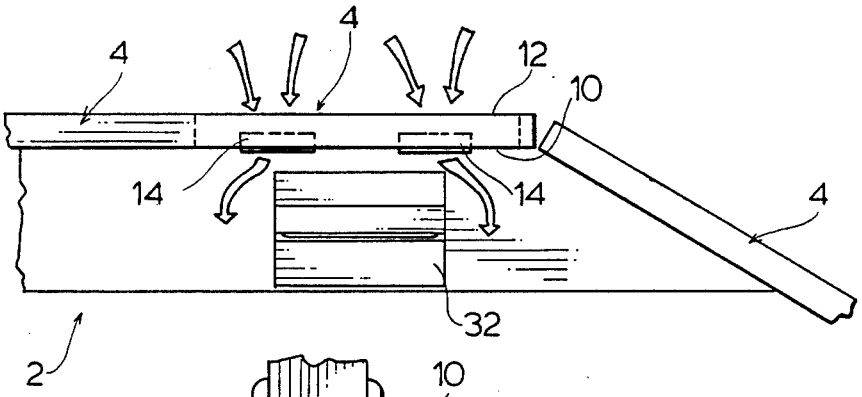
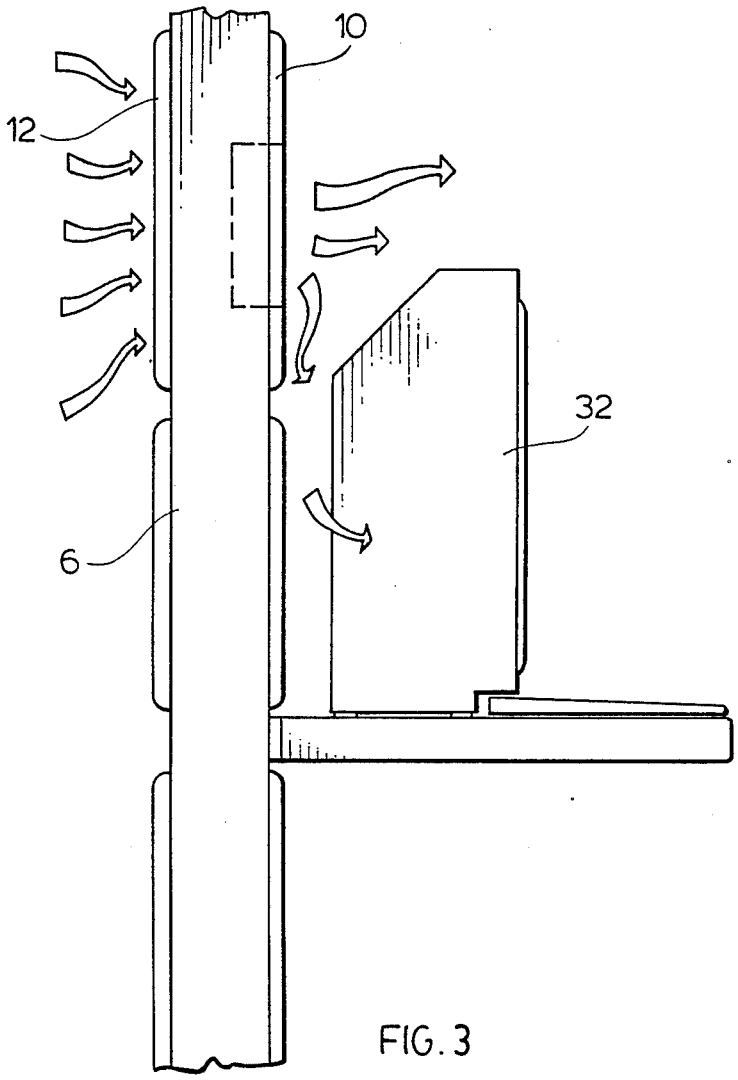
FIG. 3

VENTILATED PANEL

BACKGROUND OF THE INVENTION

The present invention relates to office panelling systems and in particular, relates to air circulation through office panelling systems.

A host of modular office panelling systems are used to subdivide office space in commercial office buildings as these panelling systems can provide flexibility in office layout changes, flexibility in the attachment of equipment to the panelling system, vertical adjustability, and full versatility with respect to removing of panels. Most office panels now include communication conduits and electrical power conduits for convenience and efficiency.

One such panelling system is disclosed in our U.S. Pat. No. 4,535,577 issued Aug. 20, 1985.

The office environment now includes the extensive use of computer consoles and other equipment which generate varying amounts of heat. Often these units include their own control fans for removing heat from the unit and dissipating it to the air. In contrast, office panelling systems tend to restrict the free flow of air throughout the environment and can act as a block restricting flow about such equipment. Furthermore, often cubicle type areas are defined by the panelling system and a considerable heat build-up within such an area can occur. It would therefore be desirable to provide a simple means for accommodating improved circulation of air within an office environment and in particular, a means of removing heat or dissipating heat from a small area to a larger area.

SUMMARY OF THE INVENTION

In a modular office panel in accordance with the present invention, the panel has removable cover panel portions either side thereof and a support frame generally interior to the panel cover portions. The improvement comprises electric fan means mounted in one of the panel cover portions and means for air to pass through a panel cover portion opposite the fan means. The fan means has an inlet and an outlet positioned to opposite sides of the panel cover portion whereby the fan means, when operated, causes a flow of air from one side of the panel through said panel to the opposite side of the panel.

Such a fan means can advantageously be electrically connected to the electrical power supply provided in the panel. Thus, there is no requirement for any external electrical connection other than that already provided to the panel.

In an office panelling system according to the present invention, a removable panel cover has mounted therein an electric fan. The fan is orientated for causing a flow of air to pass through the removable panel cover when the fan is operated and be exhausted from the panel.

BRIEF DESCRIPTION OF THE DRAWINGS

Preferred embodiments of the invention are shown in the drawings, wherein:

FIG. 2 is a top view of the partial perspective view of FIG. 1 showing the flow of air through an office panel;

FIG. 3 is a side view of a computer console and an office panel having a fan for causing a flow of air therethrough;

DETAILED DESCRIPTION OF THE PREFERRED EMDODIMENTS

Figure 1:
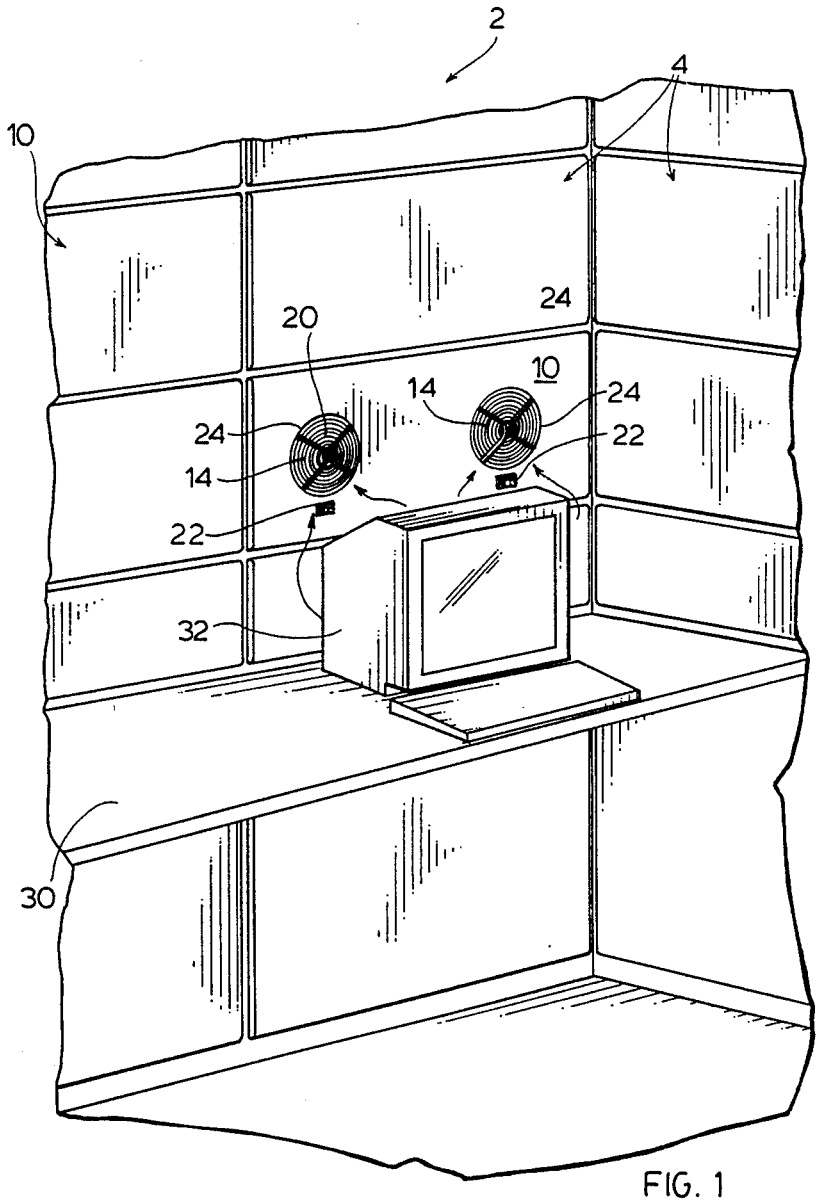
FIG. 1 is a partial perspective view of an office panelling system comprising a plurality of office panels having associated therewith a computer console.

As can be appreciated from considering FIGS. 1 through 3, the computer console 32 will generate a substantial heat load and it is often desirable to quickly dissipate this heat load to the surrounding environment. The office panelling system 2, which supports the computer console 32 and places the computer console in close proximity thereto, tends to retain this heat and reduces air flow about the computer console.

To overcome this disadvantage, panel cover portion 10 has been provided with two electric fans 14 in side by side relationship within the panel cover portion 10. Associated with this panel cover portion 10 is panel cover portion 12 generally shown in FIG. 4. Panel cover portion 12 includes a metal grill face 16 which allows air to pass through the grill. Each electric fan 14 includes an exhaust 20 and an inlet 18 which, in this case, allows the air drawn in through the metal grill face 16 to pass through the particular fan 14 and under pressure leave the panel 4. The office panel 4 includes a metal support frame 6 which defines a generally rectangular opening 8 defining a clear interior area to the office panel 4. Thus, the air is drawn into the panel by the fan 14 and discharged under pressure from the fan into the restricted area to be ventilated. This forced air will improve mixing of air and a continuous flow of air out of the restricted area.

Operation of the fans is controlled by fan switches 22 located beneath the fan grills 24 provided in the front face 40 of the panel cover portion 10. Behind the front face 40 is a support substrate 42. The electric fans 14 are positioned within cutouts of the front face 40 and the support substrate 42.

Figure 4:
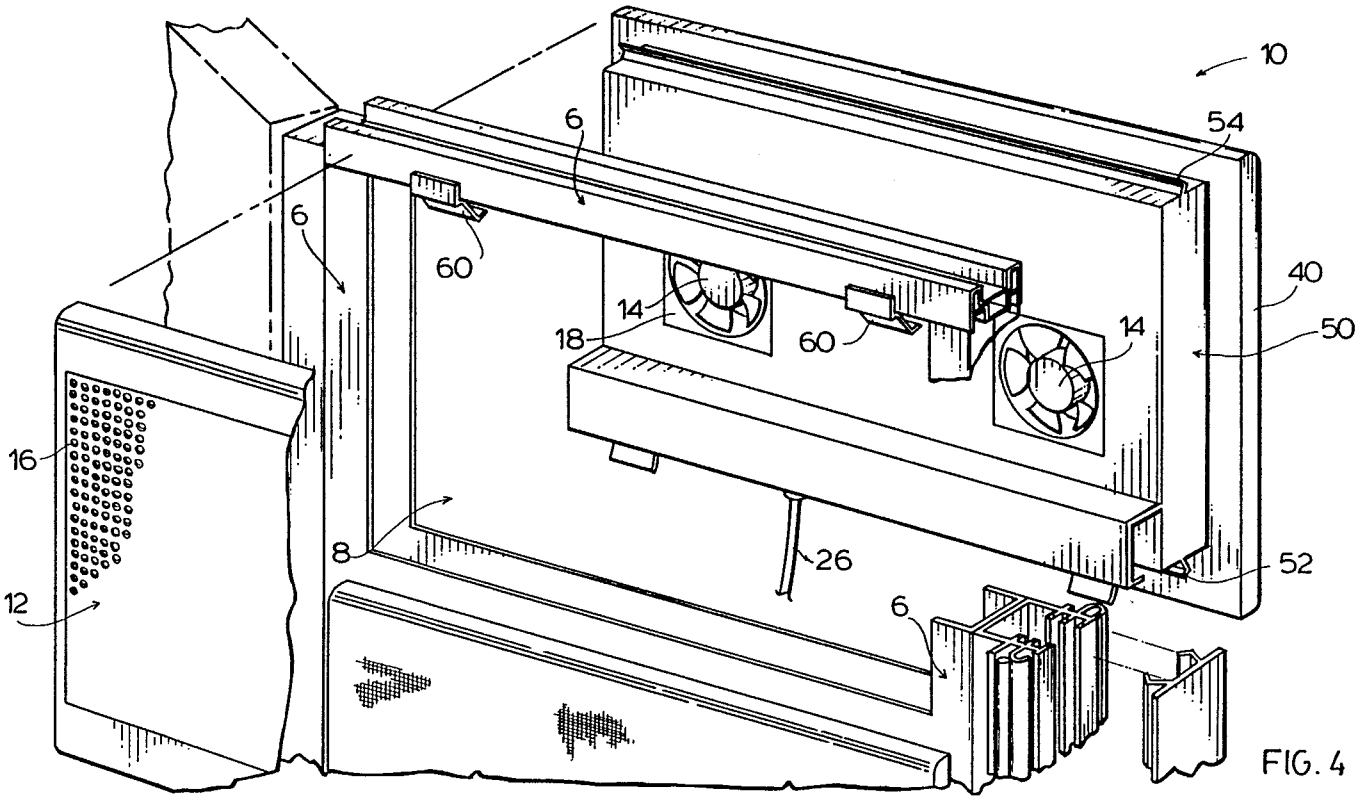
FIG. 4 is a partial exploded perspective view of an office panel having an electric fan means associated therewith.
Figure 5:
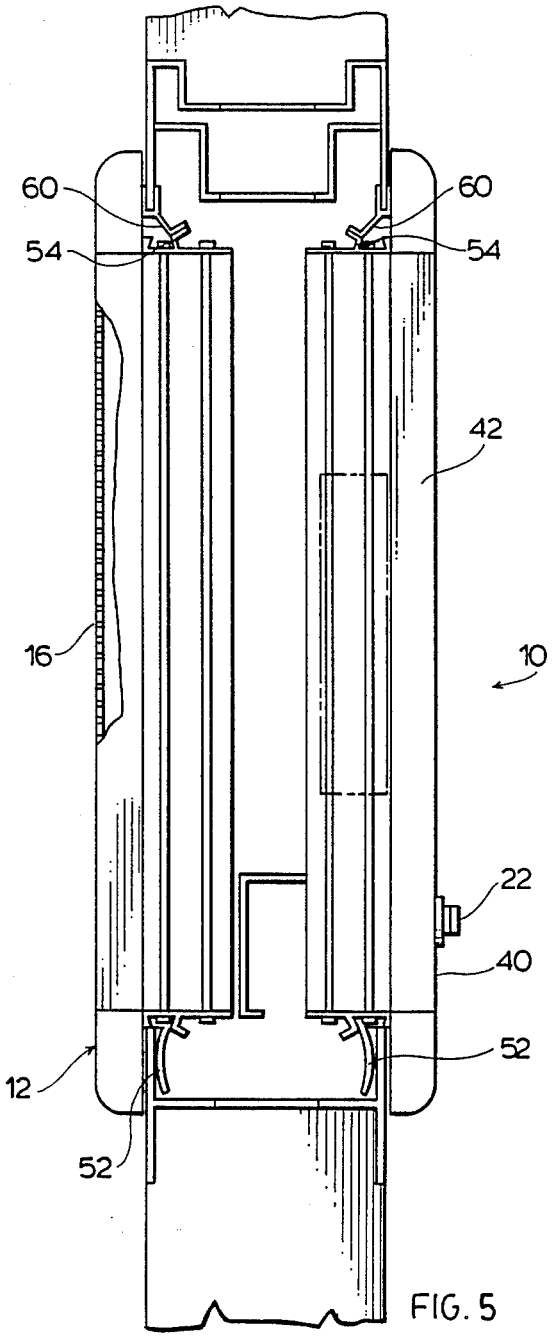
FIG. 5 is a sectional view through a panel showing the details of the mounting arrangement of the panel having a fan therein and the associated panel thereof.

As shown in FIG. 4, the fan mounting panel cover portion 10 includes a rear fan support structure 50 which defines a complete extension of the rear of the office panel 10 and engages the support frame 6 of the office panelling system. Thus, the fans are directly supported by the frame.

In the example shown, the lower edge of the fan support module includes a downwardly extending flange 52 which provides a slot forward thereof which will engage one edge of the support frame 6 when placed in engagement therewith. The top edge includes a second flange 54 which provides a spring-like connection with clips 60 provided at the associated edge of the panel. Thus, the lower edge of the panel is brought into engagement with the frame by downward placement of the panel such that the edge of the frame is engaged within a slot, whereafter the panel is forced inwardly to provide a spring-type fit with interior mounted clips.

A similar type arrangement is shown for the associated panel cover portion 12. Several advantages are possible by this arrangement in that, full flexibility and placement of the air circulation panel cover portions is possible and these panel cover portions can be relocated in accordance with changing variations of the office design. Furthermore, the structure advantageously uses the electrical power capability of the panel such that exterior electrical cords are avoided, as all electrical connection of the fan is interior to the panel. This arrangement also allows the retrofit of panels in accordance with the changing requirements of the user and in accordance with the changing characteristics of the environment.

The invention has been described with respect to a flow of air into the restricted area through the panel, however, it is possible to exhaust air from the restricted area through the panel. If reversible air flow fans are used, the system could work to cause an air flow in either direction depending upon the preference of the user.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In combination, a modular office panel having a support frame with removable panel cover portions on either side thereof, said support frame being generally interior to said panel cover portions; and electric fan means mounted about a port in one of said panel cover portions and means for air to pass through a panel cover portion opposite said fan means, said fan means having an inlet and an outlet positioned to opposite sides of said panel cover portions, whereby said fan means when operated causes a flow oa air from one side of said panel through said panel to the opposite side of said panel, said electric fan means being connected to a power supply interior to said panel.

2. In combination as claimed in claim 1, wherein said panel cover portion opposite said fan means includes a metal grill.

3. In combination as claimed in claim 2, wherein said electric fan means draws air through said metal and exhausts the air from said electric fan means.

4. In combination as claimed in claim 3, wherein said electric fan means includes two electrical fans each controlled by separate switches mounted in said one panel cover portion and accessible from the exterior of said one panel cover portion.

5. In combination as claimed in claim 4, wherein said support frame defines a clear area therewithin which houses said fans and allows air to pass through said panel.

6. In combination as claimed in claim 5, wherein said one panel cover portion includes a fan mounting support interior to said panel which cooperates with said frame to support said fan.

7. In combination as claimed in claim 6, wherein said frame is of a fabricated metal construction.

8. In combination as claimed in claim 6, wherein said fan mounting support includes at a lower edge thereof a downwardly opening slot means which snuggly engages a horizontal edge of said frame and by means of which said one cover portion is partially secured to said frame.

9. In combination as claimed in claim 7, wherein the face of said one cover portion is of a metal material.

10. In combination, an office panelling system having removable panel covers supported by metal frames generally interior to said panel covers, at least one of said covers having mounted thereon about a port in said panel an electric fan, said fan being oriented for causing a flow of air to pass through said removable panel cover when said fan is operated, and exhaust means for allowing air to leave the panelling system and wherein said electric fan is connected to an electrical supply interior to said office panelling system.

11. In combination as claimed in claim 10, wherein said removable panel cover includes a metal face with a support substrate therebehind with a fan mounting housing behind said metal face and attached to said support substrate, said support substrate including means for cooperating with said office panelling system to be supported by a frame thereof.

12. In combination as claimed in claim 11, wherein said removable panel includes two fans positioned in side by side relation and generally centered with said removable panel.

13. In combination as claimed in claim 12, wherein each fan includes a protective grill which is generally flush with said metal face.

14. In combination as claimed in claim 13, wherein said fans are electrically connected to an electrical outlet internal to said office panelling system by means of electrical wires internal to the office panelling system.

15. In combination as claimed in claim 14, including separate electrical switch means exposed through said metal face for actuating said fans.

* * * * *